US007221862B1

(12) United States Patent
Miller et al.

(10) Patent No.: US 7,221,862 B1
(45) Date of Patent: May 22, 2007

(54) CONTROL AND METHOD FOR OPERATING AN ELECTRIC WATER HEATER

(75) Inventors: William E. Miller, Centerburg, OH (US); Richard Miu, Lexington, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 5 days.

(21) Appl. No.: 11/297,753

(22) Filed: Dec. 8, 2005

(51) Int. Cl.
*H05B 1/02* (2006.01)

(52) U.S. Cl. ..... 392/498; 394/441; 394/497; 219/497

(58) Field of Classification Search ..... None
See application file for complete search history.

(56) References Cited

U.S. PATENT DOCUMENTS 5,168,546 A * 12/1992 Laperriere et al. ..... 392/454
5,808,277 A * 9/1998 Dosani et al. ..... 219/481
6,137,955 A * 10/2000 Krell et al. ..... 392/454
6,242,720 B1 * 6/2001 Wilson et al. ..... 219/486
6,293,471 B1 * 9/2001 Stettin et al. ..... 236/20 R
6,308,009 B1 * 10/2001 Shellenberger et al. ..... 392/454
6,363,216 B1 * 3/2002 Bradenbaugh ..... 392/463
6,633,726 B2 * 10/2003 Bradenbaugh ..... 392/463
6,795,644 B2 * 9/2004 Bradenbaugh ..... 392/463

* cited by examiner

*Primary Examiner*—Thor S. Campbell
(74) *Attorney, Agent, or Firm*—Harness, Dickey & Pierce, PLC

(57) ABSTRACT

A water heater control for an electric water heater operates according to at least one fixed hardware and/or software temperature limit and a variable software temperature limit. The control monitors a temperature of water in a tank of the electric water heater to determine if the temperature exceeds the fixed hardware and/or software temperature limit. If the temperature exceeds the fixed temperature limit, the control turns off one or more heating elements of the electric water heater. The variable software temperature limit is indicative of a desired user temperature and an offset temperature. If the temperature exceeds the variable software temperature limit, the control turns off the one or more heating elements.

24 Claims, 4 Drawing Sheets

CONTROL AND METHOD FOR OPERATING AN ELECTRIC WATER HEATER

FIELD OF THE INVENTION

The present invention relates to electric water heater control, and more particularly to an electric water heater control employing a method for detecting high temperature conditions in electric water heaters.

BACKGROUND OF THE INVENTION

This application relates to the art of controls and methods for operating electric water heaters. The invention is particularly applicable to a control apparatus and method that uses a control module running software for operation of a water heater. However, it will be appreciated that the invention has broader aspects and can be practiced in other forms.

An electric water heater energizes one or more heating elements located within the water heater tank to heat water. Electrical power to the heating elements is managed through the operation of a control module, which controls the opening and/or closing of electrical relays connected in series between a power source and the heating elements. The thermal energy generated by the heating elements dissipates in the water, thereby heating the water according to a desired or preset water temperature. The control module is operable to interrupt power to the heating elements, limiting the possibility that the water temperature will substantially exceed the desired temperature, by opening one or more of the electrical relays. However, certain circumstances may cause the heating elements to heat the water above the desired water temperature, resulting in a high temperature condition. For example, one or more of the relays may malfunction and/or fuse shut, limiting the ability of the control module to open and/or close the relays. If a relay fuses shut, the control module will not be able to open the relay and the heating elements will continue to heat the water.

It is known that one or more electric water heater components involved with the heating of the water may be designated as "critical" components. Electric water heater components are identified as critical components if failure of that particular component may directly result in a high temperature condition in the water heater. For example, if the failure of a relay would cause a high temperature condition, the relay is identified as a critical component. Critical components are more costly and have very high reliability requirements. It is desirable, therefore, to minimize the number of critical components in an electric water heater, which simultaneously minimizes the potential for a high temperature condition.

SUMMARY OF THE INVENTION

A water heater control for an electric water heater operates according to at least one fixed hardware and/or software temperature limit and a variable software temperature limit. The water heater control includes at least one sensor that determines a temperature of water in a tank of the electric water heater and generates a temperature signal indicative of the temperature. A control module receives the temperature signal and generates a first control signal that is indicative of a first relationship between the temperature signal and a first temperature threshold. The first control signal turns OFF and/or turns ON a heating element according to the first relationship. The control module generates a second control signal indicative of a second relationship between the temperature signal and a second temperature threshold. The second control signal turns OFF and/or turns ON a heating element according to the second relationship.

An electric water heater control method comprises sensing a temperature of water in a water heater tank. A first signal is generated at a first control module if the temperature is greater than a first temperature that is indicative of a desired temperature. A second signal is generated at a second control module if the temperature is greater than a second temperature threshold. The first signal and the second signal are received at a switching module that turns OFF one or more heating elements in response to one of the first and/or the second signal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Figures 1, 2:
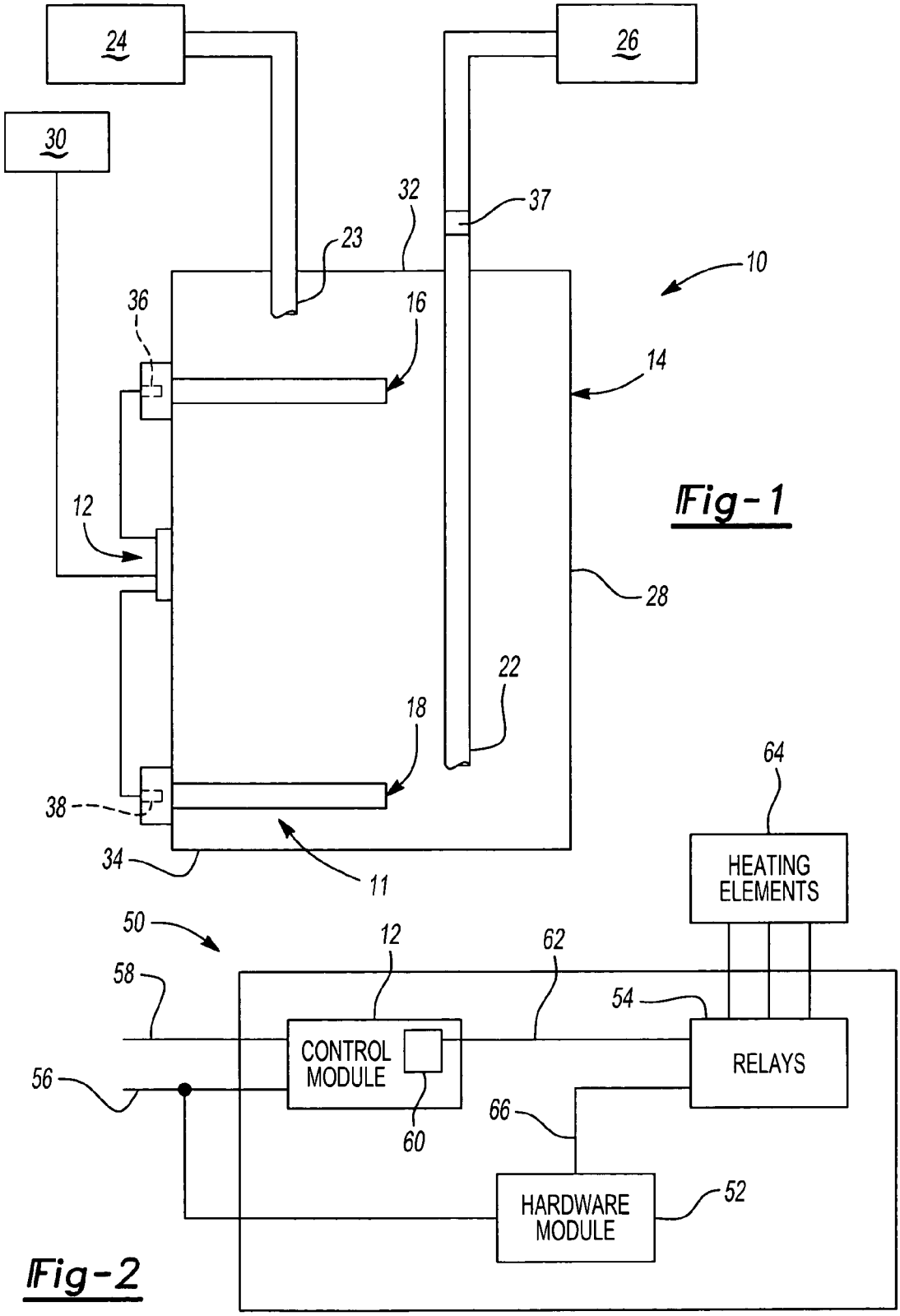
FIG. 1 is a schematic diagram of a conventional electric water heater.
FIG. 2 is a functional block diagram of a conventional water heater control.

With reference to FIG. 1, the electric water heater 10 is shown and includes a tank 14, an upper heating element 16, and a lower heating element 18. The tank 14 defines an inner volume 11 and includes an inlet 22 and an outlet 23, both fluidly coupled to the inner volume 11. The inlet 22 is fluidly coupled to a water supply 24 while the outlet 23 is connected to building fixtures such as faucets and showers, schematically represented as 26 (FIG. 1). In this manner, the inlet 22 receives a constant supply of cold water under pressure from the building supply 24 such that the inner volume 11 of the tank 14 is always full of water. Water only exits the tank 14 via outlet 23 when water is consumed at one of the fixtures 26 throughout the building. Therefore, cold water only enters the tank 14 when hot water is consumed (i.e., exits the tank 14 via outlet 23).

The upper heating element 16 extends through a side wall 28 of the tank 14 and generally into the inner volume 11. The upper heating element 16 is electrically connected to a building power supply 30 and is disposed near to an upper wall 32 of the tank 14. The upper heating element 16 receives current from the power supply 30 via control module 12 such that the control module 12 regulates the upper heating element 16 between an ON state and an OFF state.

The lower heating element 18 extends through the side wall 28 of the tank 14 and generally into the inner volume 11. The lower heating element 16 is electrically connected to the building power supply 30 and is disposed near to a lower wall 34 of the tank 14 such that the lower heating element 18 is generally closer to the lower wall 34 of the tank 14 than the upper heating element 16 is to the upper wall 32. The lower heating element 18 receives current from the power supply 30 via control module 12 such that the control module 12 regulates the lower heating element 18 between an ON state and an OFF state.

The electric water heater 10 also includes an upper temperature sensor 36 and a lower temperature sensor 38, each in communication with the control module 12. The upper and lower temperature sensors 36 and 38 are in communication with the control module 12 such that readings from the upper and lower temperature sensors 36 and 38 are transmitted to the control module 12 for processing.

The upper temperature sensor 36 is disposed adjacent to the upper heating element 16 to monitor a temperature of water within the tank 14 generally between the upper heating element 16 and the upper wall 32. The lower temperature sensor 38 is disposed adjacent to the lower heating element 18 to monitor a temperature of water within the tank 14 generally between the lower heating element 18 and the upper heating element 16. The temperature sensors 36 and 38 are preferably thermistors, such as an NTC thermistors, but could be any suitable temperature sensor that accurately reads the temperature of the water within the tank 14.

During operation, the control module 12 receives information from the sensors 36 and 38 for use in selectively actuating the upper heating element 16 and/or lower heating element 18 to the ON state. Furthermore, a flow sensor 37 could be disposed at the inlet 22 or the outlet 23 of the tank 14 to monitor a flow of water entering or exiting the tank 14. The flow sensor 37 can be used to indicate exactly how much water has been consumed over a predetermined amount of time and can therefore be used in determining when the upper and lower heating elements 16, 18 should be toggled to the ON state to thereby heat water disposed within the tank 14.

An exemplary electric water heater control 50 is shown in FIG. 2. The water heater control 50 includes a control module 12, a fixed hardware control module 52, and a relay module 54. The control module 12 receives one or more water temperature inputs 56 and 58 from temperature sensors as described in FIG. 1. Additionally, the fixed hardware control module 52 receives at least one of the water temperature inputs 56 and 58. The control module 12 and the fixed hardware control module 52 communicate with the relay module 54.

The control module 12 is an electronic circuit and/or memory, such as a processor, that execute one or more software or firmware programs. For example, the control module 12 may include one or more software modules. In particular, the control module 12 includes a fixed software control module 60 that communicates with the relay module 54. The water temperature inputs 56 and 58 are indicative of the temperature of the water inside the water heater tank and communicate the water temperature to the control module 12. The fixed software control module 60 receives the water temperature inputs 56 and 58 and processes the water temperature and any other relevant data in order to generate a software relay control signal 62. The software relay control signal 62 determines a status of the relay module 54. For example, if the water temperature exceeds a particular threshold, the control module 12, by way of the fixed software control module 60 and the software relay control signal 62, opens or closes one or more relays of the relay module 54 in order to power ON or OFF one or more heating elements, represented schematically at 64.

The fixed hardware control module 52 operates similarly to the fixed software control module 60 in order to control the relay module 54. The fixed hardware control module 52 is an electronic circuit that includes one or more electronic components that generate a hardware relay control signal 66. The fixed hardware control module 52 generates the hardware relay control signal 66 in response to the water temperature input 56. The hardware relay control signal 66 determines a status of the relay module 54 in order to power ON or OFF one or more heating elements 64. In this manner, both the fixed software control module 60 and the fixed hardware control module 52 are operable to control power to the heating elements 64. In the event of a failure of one of the fixed software control module 60 or the fixed hardware control module 52, the electric water heater control 50 is nonetheless able to power OFF the heating elements 64.

Figure 3:
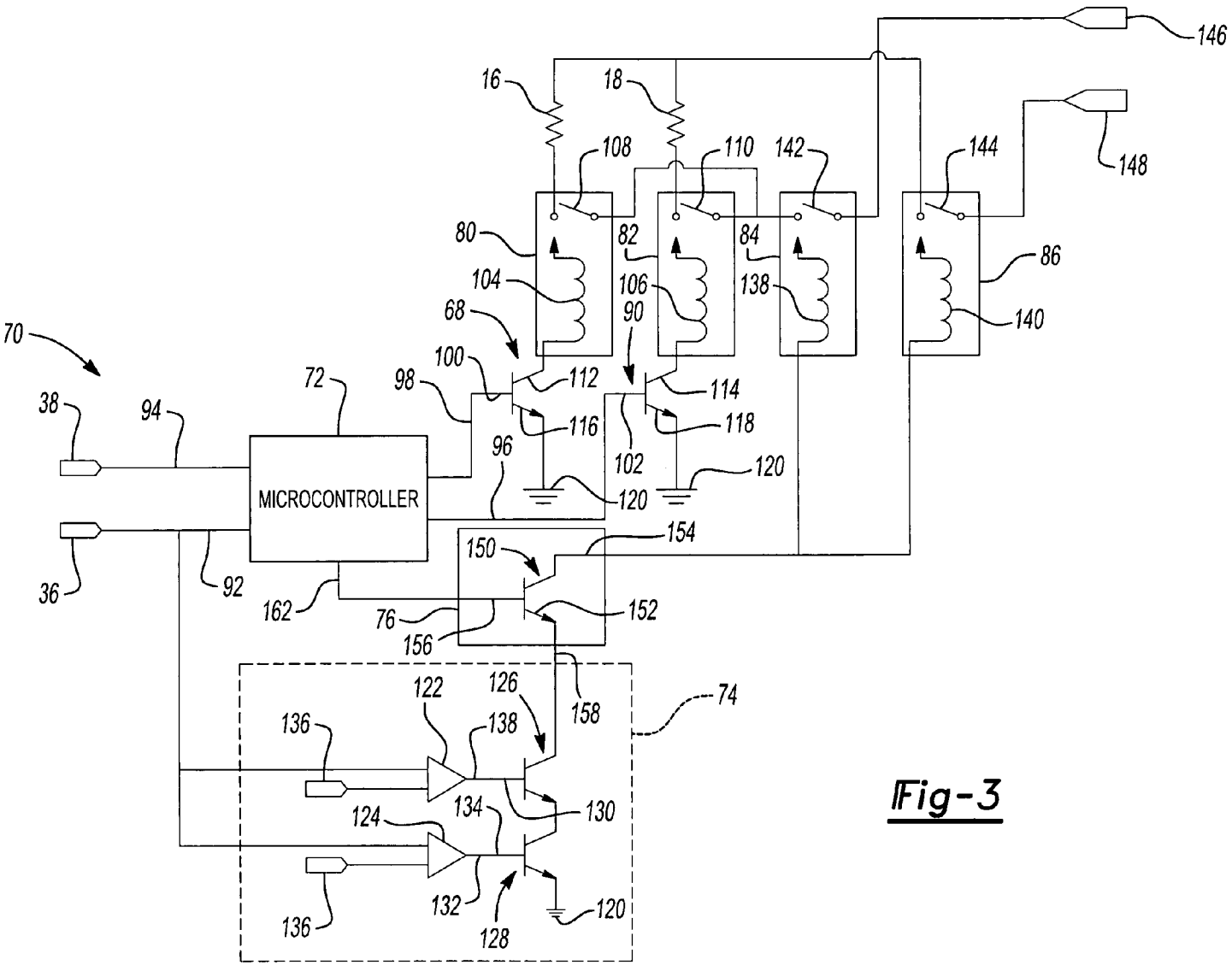
FIG. 3 is a schematic diagram of a water heater control including a fixed and variable temperature threshold according to the invention.

Referring now to FIG. 3, the electric water heater control 70 of the present invention provides fixed hardware and software limits, as well as a variable software limit. The electric water heater control 70 includes a control module 72, a fixed hardware control module 74, and a variable software control module 76. The electric water heater control 70 includes relays 80, 82, 84, and 86 and transistors 88 and 90. The control module 72 and/or the fixed hardware control module 74 opens and closes the relays 80, 82, 84, and 86 according to water temperature inputs 92 and 94. Under normal operating conditions, relays 84 and 86 are closed, and one of the relays 80 or 82 is closed. The other of the relays 80 or 82 is open. In this manner, only one of upper heating element 16 or the lower heating element 18 is energized at any given time. The electric water heater control 70 energizes the lower heating element 18 when the temperature of the water within a proximity of the lower heating element 18 is less than a first threshold. When the water temperature within a proximity of the upper heating element 16 is less than a second threshold, the electric water heater control de-energizes the lower heating element 18 and energizes the upper heating element 16. However, if the water temperature exceeds a fixed upper threshold (e.g. 165° F.), the electric water heater control 70 is operable to open one or more of the relays 80, 82, 84, and 86 in order to de-energize both the upper and lower heating elements 16 and 18 as described below.

First and second software relay control signals 96 and 98 are connected to gate nodes 100 and 102 of transistors 88 and 90, respectively. If water temperature inputs 92 and 94 indicate that the water temperature is below the threshold, the transistors 88 and 90 are ON. The relays 80 and 82 include solenoids 104 and 106 and switches 108 and 110. The solenoids 86 and 88 are connected to source nodes 112 and 114, respectively. If the transistors 88 and 90 are ON, the solenoids 104 and 106 are energized, and switches 108 and 110 are closed. Drain nodes 116 and 118 are connected to ground 120. Conversely, when the temperature inputs 92 and 94 indicate that the water temperature exceeds the threshold, the control module 72 turns transistors 88 and 90 OFF, and switches 108 and 110 are open.

The fixed hardware control module 74 includes comparators 122 and 124 and transistors 126 and 128. Output 128 of the comparator 122 is connected to a gate node 130 of the transistor 126. Similarly, output 132 of the comparator 124 is connected to a gate node 134 of the transistor 128. Each of the comparators 122 and 124 receives the water temperature input 92 and a reference voltage 136. Although the comparators 122 and 124 receive the water temperature input 92 from the upper temperature sensor 36, it is to be understood that the water temperature input 94 from the lower temperature sensor 38 might also be used.

The fixed hardware control module 74 opens and closes relays 84 and 86 according to the water temperature input 92. The relays 84 and 86 include solenoids 138 and 140 and switches 142 and 144. If the water temperature exceeds a particular threshold, the fixed hardware control module 74 opens the relays 84 and 86 in order to power OFF the upper and lower heating elements 16 and 18. If the temperature input 92 indicates that the water temperature is below the threshold, transistors 126 and 128 are ON, solenoids 138 and 140 are energized, and switches 142 and 144 are closed. Conversely, if the temperature input 92 indicates that the water temperature exceeds the threshold, transistors 126 and 128 are OFF and switches 142 and 144 are open.

When the switches 108, 142, and 144 are closed, the upper heating element 16 is energized through AC power lines 146 and 148. Conversely, if one or more of the switches 108, 142, and 144 are open, the power through the upper heating element 16 is interrupted. When the switches 110, 142, and 144 are closed, the lower heating element 18 is energized through the AC power lines 146 and 148. If one or more of the switches 110, 142, and 144 are open, the power through the lower heating element 18 is interrupted. Therefore, either the control module 72 or the fixed hardware control module 74 is able to interrupt the power to the upper and lower heating elements 16 and 18. In the event of a component failure that causes the control module 72 to lose its ability to open the switches 108 and/or 110 and interrupt power to the upper and lower heating elements 16 and 18, the fixed hardware control module 74 is still able to open the switches 142 and 144 and de-energize the heating elements 16 and 18. In other words, the control module 72 provides software control over the switches 108 and 110 based on a fixed software limit, and the fixed hardware control module 74 provides hardware control over the switches 142 and 144.

In the event that switches 108 and 110 are fused closed, continuously energizing the upper and lower heating elements 16 and 18, the control module 72 is able to interrupt power by opening switches 108 and 110 as described above. However, the electric water heater control 70 also provides control of switches 142 and 144 with the variable software control module 76. In a preferred embodiment, the variable control module 76 includes a transistor 150. A drain node 152 of the transistor 150 is connected to the fixed hardware control module 74. A source node 154 of the transistor 150 is connected to the switches 142 and 144 through the solenoids 138 and 140, respectively. The control module 72 communicates with a gate node 156 of the transistor 150.

The control module 72 controls the relays 80 and 82 with software relay control signals 96 and 98 according to temperature inputs 92 and 94. Similarly, the fixed hardware control module 74 controls the relays 84 and 86 with an output 158. However, the transistor 150 is either OFF or ON according to a variable control signal 162 of the control module 72. Therefore, the control capabilities of the fixed hardware control module 74 with respect to the relays 84 and 86 are subject to the software control of the control module 72. Under normal operating conditions, temperature inputs 92 and 94 indicate that the water temperature is below the threshold, and therefore one of the switches 108 and 110 is closed, as well as both of the switches 142 and 144. Transistors 88 and 90 are ON as described above. Additionally, the transistor 150 is ON in response to the variable control signal 162, allowing the fixed hardware control module 74 to energize solenoids 138 and 140. If the control module 72 turns the transistor 150 OFF, the switches 142 and 144 are open, regardless of the output 158 of the fixed hardware control module 74. Therefore, the control module 72 is able to control the relays 84 and 86 independently of the fixed hardware control module 74. For example, if the control module 72 malfunctions, the fixed hardware control module 74 may open the switches 142 and 144. Conversely, if the fixed hardware control module 74 malfunctions, the control module 72 can turn the transistor 150 OFF and open the switches 142 and 144.

The fixed hardware control module 74 may operate in accordance with limitations in the accuracy of the components used. For example, a fixed hardware temperature threshold may be set at 170° F. However, the fixed hardware control module 74 opens the switches 142 and 144 according to plus or minus 5° F. of accuracy. Therefore, the fixed hardware control module 74 may open the switches 142 and 144 at as low as 165° F. or as high as 175° F.

Similarly, the control module 72 controls the relays 80 and 82 according to a 170° F. fixed software temperature threshold. Additionally, the control module 72 may implement a variable software temperature threshold. For example, the outputs 96, 98, and 162 control the relays 80, 82, 84, and 86 according to comparison between the temperature inputs 92 and 94 and one of the fixed hardware temperature threshold and/or the fixed software temperature threshold. However, the output 162 may control the transistor 150, and therefore relays 84 and 86, according to the variable software temperature threshold, such as a limit set by a user. If the user sets the desired temperature of the water heater lower than the 170° F. fixed temperature thresholds, the variable software temperature threshold is determined according to this desired temperature and an offset. For example, the variable software temperature threshold may be an offset of 5° F. higher than the desired temperature. Therefore, if the water temperature exceeds the desired temperature by 5° F., the control module 72 turns OFF the transistor 150, opening the switches 142 and 144. Additionally, the fixed hardware control module 74 is operable to open the switches 142 and 144 if the water temperature exceeds the fixed temperature threshold of 170° F.

Figure 4:
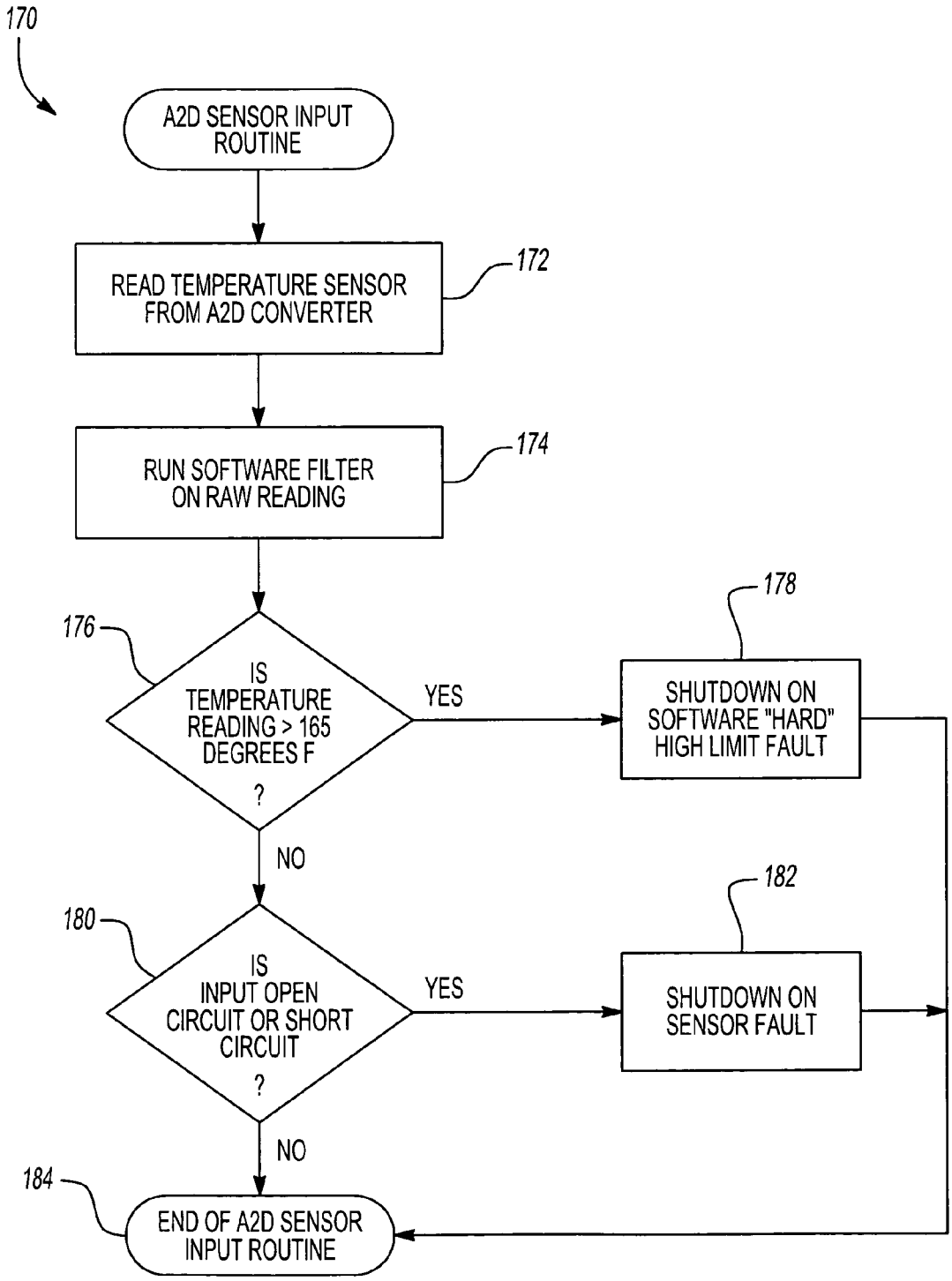
FIG. 4 illustrates a fixed software high temperature limit algorithm according to the invention.

The control module software implements a fixed high limit software algorithm 170 as shown in FIG. 4. The temperature sensor returns a raw value indicative of the temperature of the water in the water heater tank at step 172. For example, the temperature sensor may include an analog-to-digital (A/D) converter as is known in the art. The algorithm 170 filters the raw value at step 174 and outputs a temperature reading. The filter removes extraneous temperature readings from the algorithm 170. For example, temperature readings that exceed a predetermined temperature range due to current spikes or other noise are not considered. At step 176, the algorithm 170 determines if the temperature reading is above a fixed software temperature threshold. For example, the fixed software temperature threshold may be the 170° F. temperature threshold as described in FIG. 3. If the temperature reading is above the fixed software temperature threshold, the control module returns a high temperature limit fault and shuts OFF the heating elements at step 178. If the temperature reading is not above the fixed software temperature threshold, the algorithm 170 determines if there is an open circuit or short circuit condition at step 180. If the algorithm 170 detects an open circuit or a short circuit, the algorithm 170 shuts OFF the heating elements at step 182. If the algorithm 170 does not detect a short circuit or an open circuit, the algorithm 170 continues to step 184. At step 184, the algorithm 170 ends. The algorithm 170 may repeat for additional temperature readings. For example, the algorithm may repeat at regular intervals during the operation of the water heater.

Figure 5:
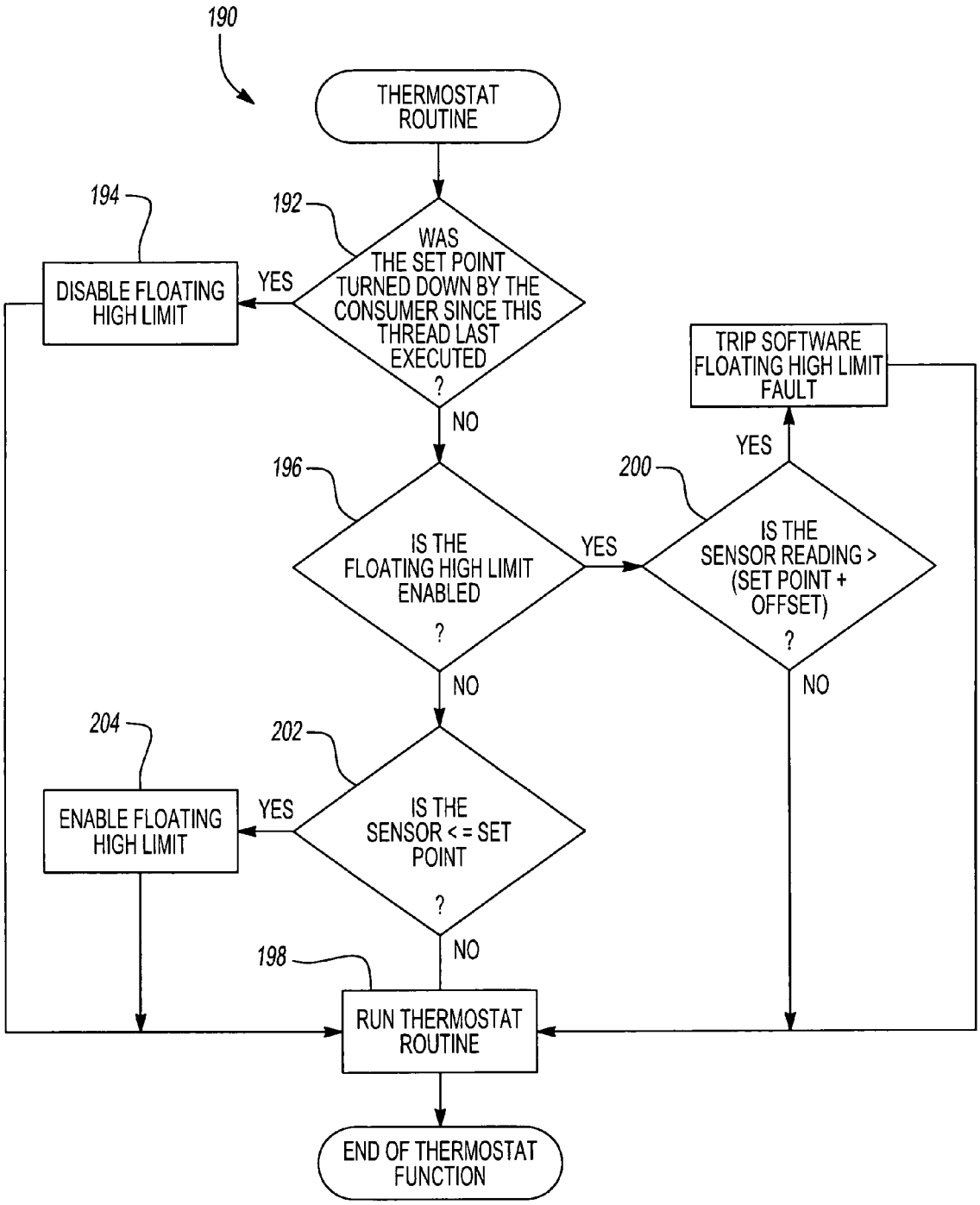
FIG. 5 illustrates a variable software temperature limit algorithm according to the invention.

The control module software implements a variable high limit software algorithm 190 as shown in FIG. 5. At step 192, the algorithm 190 determines if the user set point for the desired temperature was recently lowered. If the user set point was lowered, then the algorithm 190 disables the variable software temperature threshold at step 194. The variable software temperature threshold is dependent on the user set point. Therefore, if the algorithm 190 did not disable the variable software temperature threshold in this situation, the water temperature would immediately be higher than the variable software temperature threshold upon lowering of the user set point, and the water heater control would de-energize the heating elements. If the user set point was not recently lowered, the algorithm 190 continues to step 196. If the user set point was recently lowered (i.e. lowered after a previous iteration of the algorithm 190), then the algorithm 190 continues from step 194 to step 198. At step 198, the algorithm 190 repeats.

At step 196, the algorithm 190 determines if the variable software temperature threshold is enabled. If the variable software temperature threshold is enabled, the algorithm 190 continues to step 200. If the variable software temperature threshold is not enabled, the algorithm 190 determines if the water temperature sensor reading is less than or equal to the set point at step 202. If the sensor reading is not less than or equal to the set point, the algorithm 190 continues to step 198 and repeats. If the sensor reading is less than or equal to the set point, the algorithm 190 continues to step 204. At step 204, the algorithm 190 enables the variable software temperature threshold, and then repeats at step 198.

Steps 202, 204, and 198 operate to re-enable the variable software temperature threshold after the variable software temperature threshold has been disabled due to a high temperature condition. In other words, steps 202, 204, and 198 re-enable the variable software temperature threshold after the water temperature drops below the variable software temperature threshold.

The algorithm 190 determines if the sensor reading is greater than a temperature offset, such as 5° F., above the variable software temperature threshold at step 200. If the sensor reading is not greater than the temperature offset above the variable software temperature threshold, the algorithm 190 continues to step 198 and repeats. If the sensor reading is greater than the temperature offset above the variable software temperature threshold, the algorithm 190 continues to step 206. At step 206, a variable software temperature threshold fault occurs. The water heater control controls the heating elements according to the variable software temperature threshold fault. In the preferred embodiment, the control module opens the appropriate switches in order to interrupt power to the heating elements. Therefore, it can be seen that steps 196, 200, and 206 operate to turn OFF the heating elements if the water temperature exceeds the user set point by more than the temperature offset. The heating elements remain OFF until the water heater is powered down or reset.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control for an electric water heater, the electric water heater including at least one sensor that determines a temperature of water in the water heater and generates a temperature signal indicative of the water temperature, the control comprising:

means for receiving the temperature signal;

means for setting a desired temperature:

means for generating a first control signal indicative of a first relationship between the temperature signal and a first temperature threshold, wherein the first temperature threshold is fixed and the first control signal turns off a heating element based on the first relationship; and means for generating a second control signal indicative of a second relationship between the temperature signal and a second temperature threshold, wherein the second temperature threshold is variably based on the desired temperature and the second control signal turns off the heating element based on the second relationship, wherein each of the first temperature threshold and the second temperature threshold is greater than the desired temperature.

2. The control of claim 1 further comprising a temperature limit means for receiving the temperature signal and generating a third control signal indicative of a third relationship between the temperature signal and a reference voltage signal, wherein the third control signal causes a heating element to at least one of turn on and turn off according to the third relationship.

3. The control of claim 2 wherein the temperature limit means includes at least one comparator for receiving the temperature signal and the reference voltage signal.

4. The control of claim 3 wherein the at least one comparator generates the third control signal.

5. The electric water heater control of claim 2 wherein the reference voltage signal is indicative of a temperature limit.

6. The electric water heater control of claim 2 further comprising means for receiving the second control signal and the third control signal, and for turning off the heating element according to at least one of the second control signal and/or and the third control signal.

7. The electric water heater of claim 2 wherein the voltage reference signal is indicative of the first temperature threshold.

8. The electric water heater control of claim 1 wherein the first control signal turns off the heating element if the temperature signal is greater than the first temperature threshold and the second control signal turns off the heating element if the temperature signal is greater than the second temperature threshold.

9. The electric water heater control of claim 1 wherein the first temperature threshold is greater than the second temperature threshold.

10. The electric water heater control of claim 1 wherein the second temperature threshold is less than the first temperature threshold.

11. An electric water heater comprising:

at least one sensor that determines a temperature of water in the water heater and generates a temperature signal indicative of the temperature;

at least one heating element that heats the water;

a control module that receives the temperature signal and de-energizes the at least one heating element based on a first relationship between the temperature signal and a first temperature threshold and a second relationship between the temperature signal and a second temperature threshold, wherein the first temperature threshold is fixed, the second temperature threshold is variably based on a desired temperature, and the first temperature threshold and the second temperature threshold are greater than the desired temperature; and a temperature limit circuit that receives the temperature signal and de-energizes the at least one heating element according to the first relationship.

12. The electric water heater of claim 11 wherein the control module opens a first switch in order to de-energize the heating element if the temperature signal is greater than the first temperature threshold and opens a second switch in order to turn off the heating element if the temperature signal is greater than the second temperature threshold.

13. The electric water heater of claim 12 wherein the temperature limit circuit opens the second switch if the temperature signal is greater than the first temperature threshold.

14. The electric water heater of claim 11 wherein the first temperature threshold is greater than the second temperature threshold.

15. The electric water heater of claim 11 wherein the second temperature threshold is less than the first temperature threshold.

16. A method for operating an electric water heater comprising:

sensing a temperature of water in a water heater tank;

executing a first algorithm that turns off at least one heating element if the temperature exceeds a first temperature threshold, wherein the first temperature threshold is fix; and executing a second algorithm that turns off the at least one heating element if the temperature exceeds a second temperature threshold that is variably based on a desired temperature, wherein the first temperature threshold and the second temperature threshold are not equal and are greater than the desired temperature.

17. The method of claim 16 wherein the step of executing the first algorithm includes generating a first signal at a first control module if the temperature is greater than the first temperature threshold.

18. The method of claim 17 wherein the step of executing the second algorithm includes generating a second signal at a second control module if the temperature is greater than the second temperature threshold.

19. The method of claim 18 further comprising receiving the first signal and the second signal at a switching module that turns off one or more the at least one heating element in response to one of the first signal and/or the second signal.

20. The method of claim 18 wherein the second control module is a software module.

21. The method of claim 18 wherein the step of generating the first signal includes:

generating a temperature signal indicative of the temperature;

receiving the temperature signal at the first module;

generating a threshold signal indicative of the first temperature threshold;

receiving the threshold signal at the first module;

comparing the temperature signal to the threshold signal at the first module; and generating the first signal if the temperature signal is greater than the threshold signal.

22. The method of claim 16 wherein the second temperature threshold is less than the first temperature threshold.

23. The method of claim 16 further comprising selecting the desired temperature.

24. The control of claim 1 wherein the first control signal controls at least one first switch in communication with the heating element and the second control signal controls at least one second switch in communication with the heating element.

* * * * *

UNITED STATES PATENT AND TRADEMARK OFFICE

CERTIFICATE OF CORRECTION

PATENT NO. : 7,221,862 B1
APPLICATION NO. : 11/297753
DATED : May 22, 2007
INVENTOR(S) : William E. Miller et al.

It is certified that error appears in the above-identified patent and that said Letters Patent is hereby corrected as shown below:

Column 8,
Line 52, claim 6, after “and/or” delete “and”.

Column 9,
Line 41, claim 16, “fix” should be --fixed--.

Column 10,
Line 15, claim 19, delete “one or more”.

Signed and Sealed this

Twenty-eighth Day of August, 2007

JON W. DUDAS
*Director of the United States Patent and Trademark Office*